US006754920B2

(12) United States Patent
Fleming et al.

(10) Patent No.: US 6,754,920 B2
(45) Date of Patent: Jun. 29, 2004

(54) INFECTION CONTROL MAT

(75) Inventors: James J. Fleming, Chesterfield, MO (US); Joseph A. Kittner, Brentwood, MO (US)

(73) Assignee: T. L. Clark, Incorporated, St. Louis, MO (US)

( * ) Notice: Subject to any disclaimer, the term of this patent is extended or adjusted under 35 U.S.C. 154(b) by 0 days.

(21) Appl. No.: 10/418,697

(22) Filed: Apr. 18, 2003

(65) Prior Publication Data

US 2003/0192121 A1 Oct. 16, 2003

Related U.S. Application Data

(60) Continuation of application No. 10/039,576, filed on Oct. 26, 2001, now Pat. No. 6,568,005, which is a division of application No. 09/479,569, filed on Jan. 7, 2000, now Pat. No. 6,321,401.

(51) Int. Cl.[7] ..... A47G 9/06
(52) U.S. Cl. ..... 5/420; 5/722; 5/657; 5/707
(58) Field of Search ..... 5/420, 722, 657, 5/707, 724, 699, 706; 428/68, 69, 71, 192, 304.4, 76

(56) References Cited

U.S. PATENT DOCUMENTS

| | | | |
|---|---|---|---|
| 1,371,919 | A | 3/1921 | Mahoney |
| 2,834,970 | A | 5/1958 | Nappe |
| 3,242,509 | A | 3/1966 | Nissen |
| 3,753,823 | A | 8/1973 | Kuss |
| 4,037,591 | A | 7/1977 | Sarno |
| 4,147,828 | A | 4/1979 | Heckel et al. |
| 4,539,057 | A | 9/1985 | Ahlm |
| 4,860,395 | A | 8/1989 | Smith |
| 5,007,123 | A | 4/1991 | Salyards |
| 5,050,256 | A | 9/1991 | Woodcock |
| 5,152,018 | A | 10/1992 | Lea |
| 5,226,384 | A | 7/1993 | Jordan |
| 5,265,294 | A | 11/1993 | McClure et al. |
| 5,303,435 | A | 4/1994 | Haar et al. |
| 5,384,923 | A | 1/1995 | Hwang et al. |
| 5,552,205 | A | 9/1996 | Lea |
| 5,564,143 | A | 10/1996 | Pekar et al. |
| 5,678,266 | A | 10/1997 | Petringa et al. |
| 5,720,057 | A | 2/1998 | Duncan |
| 6,073,291 | A | 6/2000 | Davis |
| 6,122,785 | A | 9/2000 | Bondie et al. |
| 6,260,222 | B1 | 7/2001 | Lin |

OTHER PUBLICATIONS

T.L. Clark Educational Products Group '97 Catalog (front cover plus pp. 1 through 8) published by Thomas L. Manufacturing Company.

*Primary Examiner*—Teri Pham Luu
*Assistant Examiner*—Fredrick Conley
(74) *Attorney, Agent, or Firm*—Polster Lieder Woodruff & Lucchesi LC

(57) ABSTRACT

An infection resistant mat having individual segments containing foam padding and a contiguous cover of impervious material. The cover is constructed by radio frequency (RF) sealing of the seams which eliminates portals of entry of infectious organisms, vermin or fluid. Air channels within the cover communicate between the segments to allow air pressure equalization among the several segments during use. The contiguous cover creates hinges between the segments that allow the mat to be folded for storage. The mat also can be constructed with only one padded section.

4 Claims, 2 Drawing Sheets

INFECTION CONTROL MAT

CROSS REFERENCE TO RELATED APPLICATION

This application is a continuation of application Ser. No. 10/039,576, filed Oct. 26, 2001, now U.S. Pat. No. 6,568,005, which is a division of application Ser. No. 09/479,569, filed Jan. 7, 2000, now U.S. Pat. No. 6,321,401.

BACKGROUND OF THE INVENTION

This application relates generally to portable rest or sleeping surfaces and, more particularly, to a lightweight, portable, padded mat that is impervious to fluids and to invasion by infectious organisms and vermin and a method for making the same.

Rest or sleeping mattress or mats are known to the art. Generally speaking, such known mats are comprised of an outer cover around a filler or padding. In most instances the prior are expedients have filler or padding of cotton batting, foam or the like and a fabric or plastic cover. The covers of the prior art mats generally are stitched and secured around the filler. It will be appreciated by those skilled in the art that a stitched fabric cover provides innumerable portals of entry for infectious organisms, such as bacteria, or vermin such as head lice or scabies, both through the weave of the fabric and through the stitch holes. Furthermore, a cover made from a material with limited portals of entry, such as plastic, which has stitched seams still presents an unacceptably high number of sites accessible by fluid, bacteria or vermin. Furthermore, such stitched mattresses have threads that fray and pull loose and also include rough seams and sharp corners that are unacceptable on mats used by children.

A number of prior art expedients have been offered in an attempt to limit contamination of such sleeping or rest mats and mattresses by bacteria or vermin. For example, U.S. Pat. No. 1,371,919, to Mahoney, provides a vermin proof combined mattress and spring; U.S. Pat. No. 4,539,057, to Ahim, provides a method of making a protective layer of film to protect a mattress from injurious substances and bacteria; U.S. Pat. No. 5,007,123, to Salyards provides a flexible covering for reducing moisture and bacteria in a mattress; and, U.S. Pat. No. 5,265,294, to McClure et al. discloses a mattress having a seamless, impermeable PVC cover.

The prior art mattresses and covers have several drawbacks. For example, the patents either disclose large full sized mattresses or simply coverings for mattresses. It will be appreciated that full sized mattress are not particularly lightweight or portable or easily used by children. The prior art designs do not lend themselves to convenient storage and occasional use, for example, for convenient storage in a child-care center and occasional use by children for rest or nap. Furthermore, the use or application of a separate, bacteria or vermin resistant cover to a rest or nap cot is impractical. The process is time consuming, requires additional storage space, and requires the maintenance and disinfection of both the cot and the cover. Moreover, the production of a full sized mattress with a totally seamless surface can be quite costly.

Therefore, it would be advantageous to have a padded, foldable and portable infection resistant mat for use in the child-care environment, for example, that is durable and relatively simple and economical to construct, lightweight and easy to use.

SUMMARY OF THE INVENTION

It is among the several objects of the present invention to provide a padded mat that is resistant to invasion by infectious organisms and vermin.

Another object of the present invention is to provide such a mat that is lightweight and portable.

Another object of the present invention is to provide such a mat that is segmented for folding to allow convenient storage.

Still another object of the present invention is to provide such a mat that has a cover that is sealed in such a manner that it does not create portals of entry for infectious organisms, vermin, or body fluids.

Another object of the present invention is to provide such a mat that has seams with no sharp edges and no sharp corners.

Still another object of the present invention is to provide such a mat that has seams that are sealed by radio frequency (RF) welding techniques which satisfy the aforestated objects.

Yet another object of the present invention is to provide such mat that is easily and economically manufactured, convenient to use, and well suited for its intended purposes.

In accordance with the invention, generally stated, an infection resistant mat is provided having individual segments containing foam padding and a contiguous cover of impervious material. The cover is constructed by radio frequency (RF) sealing of the seams which eliminates portals of entry for infectious organisms, vermin or body fluids. Air channels communicate between the segments to allow pressure equalization among the several segments during use. The RF sealed seams eliminate sharp edges and sharp corners. The individual segments allow the mat to be folded for convenient storage. The mat also can be constructed with only one padded segment.

The mat can be constructed with the cover having the resting surface of one color and the floor-contacting surface of a contrasting color so that the resting surface always is turned up to avoid contamination. The materials are fire retardant and easily cleaned.

BRIEF DESCRIPTION OF THE DRAWINGS

Corresponding reference numerals indicate corresponding elements throughout the various drawings.

DETAILED DESCRIPTION OF THE INVENTION

Figure 5:
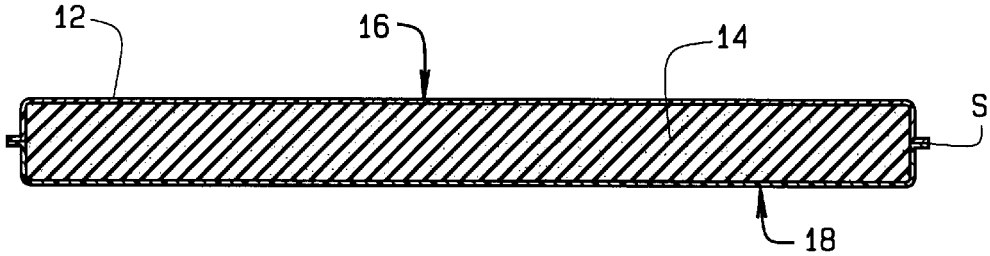
FIG. 5 is a cross-sectional view of the portable, infection resistant mat of the present invention taken along line 5—5 of FIG. 2.

The portable infection resistant mat of the present invention is indicated generally by reference numeral 10 in the drawings. Mat 10, as illustrated, includes a cover 12 and around an inner padding 14 (FIG. 5). Mat 10 can be of any size, however, a size convenient for use by children in a day care environment is preferred. For example, mat 10 can range in dimension from 19 inches by 46 inches to 24 inches by 48 inches. Of course, the mat 10 can be much wider and much longer for use by an adult. The detailed description of the elements and manufacture of mat 10 now will be described in greater detail.

Figure 3:
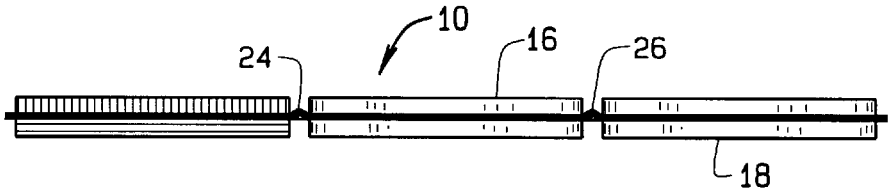
FIG. 3 is a side elevation view thereof.
Figure 4:
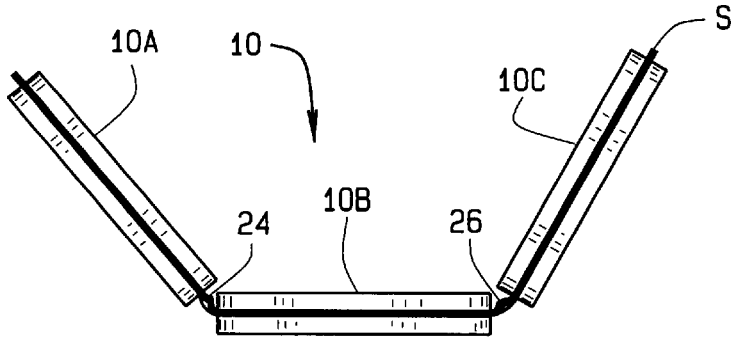
FIG. 4 is a side elevational view of the portable, infection resistant mat of the present invention, partially folded for storage.

Cover 12 of mat 10 preferably is constructed from a material which is fire retardant and durable, such as approximately 10 mil to approximately 20 mil super strong vinyl. The cover material also is easy to clean and to disinfect. Most important, however, is the fact that cover 12 is impervious to liquids, such as urine or other body fluids, and also is impervious to disease causing bacteria and impervious to vermin, such as head lice. The cover 12 of mat 10 includes a top sheet 16 and a bottom sheet 18. It will be appreciated that the top sheet 16 and the bottom sheet 18 are constructed from contrasting color materials so that the bottom sheet 18, which has contact with the floor, for example, is always placed on the floor and is not used as a resting surface (FIG. 3). Thus, the sleeping side of mat 10 is distinguished from the floor side, providing more sanitary conditions of use.

Figure 1:
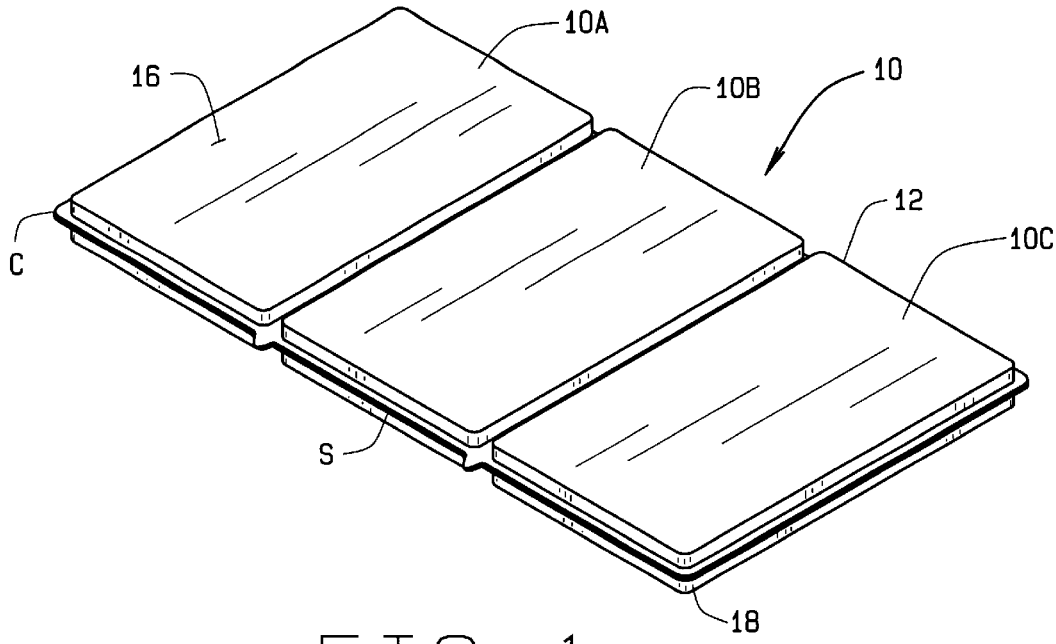
FIG. 1 is an isometric view of the portable, infection resistant mat of the present invention.
Figure 2:
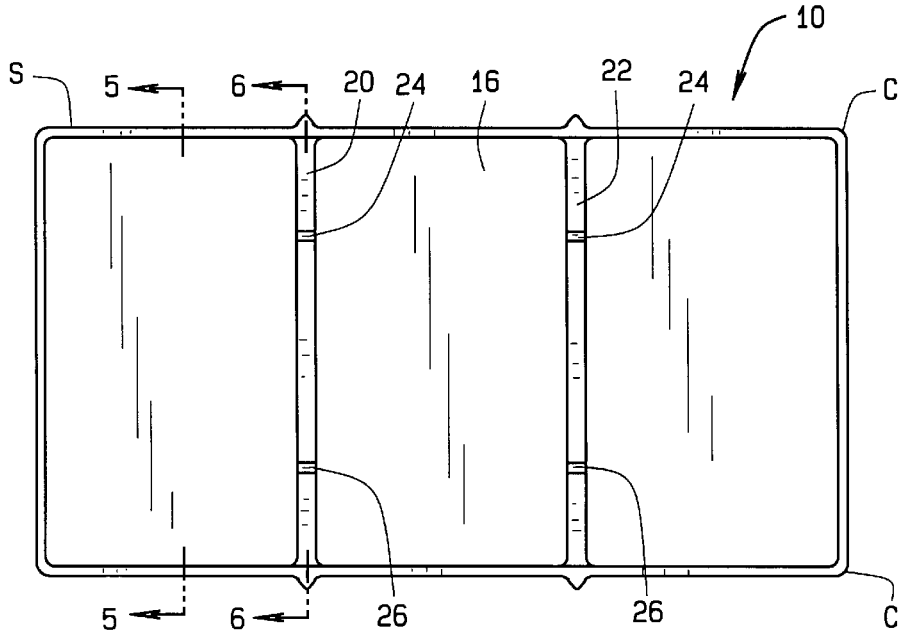
FIG. 2 is a top plan of the portable, infection resistant mat of the present invention.
Figure 6:
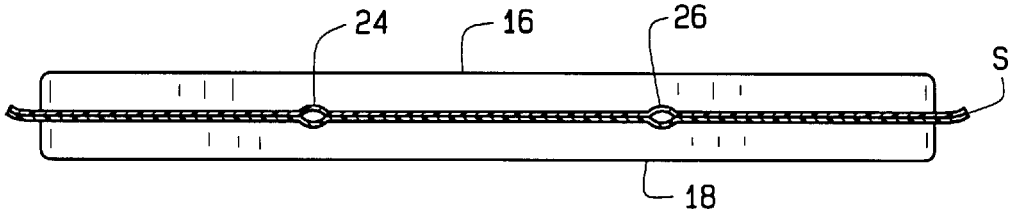
FIG. 6 is a cross-sectional view of the portable, infection resistant mat of the present invention taken along line 6—6 of FIG. 2.

As best seen in FIGS. 1–4, mat 10 is divided into segments, 10A, 10B and 10C. It will be appreciated that mat 10 can include more than three segments or fewer than three segments, depending upon the desired length of the mat. The segmented mat allows the mat 10 to be folded for storage, as shown partially folded in FIG. 4. The top and bottom cover sheets are sealed along the seams S by radio frequency (RF) welding, as will be explained in greater detail below, to form a contiguous cover. However, at this point it will be noted that the cover sheets are welded together between the segments, to create thin, flexible hinge areas 20 and 22, for example, which facilitate folding. Of course if mat 10 had more segments it also would include additional hinge areas. Referring to FIGS. 2 and 6, it will be noted that when the hinge areas 20 and 22 are sealed by RF welding, discrete areas are not welded, thereby creating air passageways 24 and 26. Air passages 24 and 26 allow for air flow between the various segments, thus equalizing pressure within the various segments when a user lays on the mat, providing a more comfortable mat. Air passages made by this method do not require hard inserts or tubing and thus are more comfortable.

Referring to FIG. 2, it will be noted that the novel RF welding technique used to produce mat 10 produces seams S without stitch holes, thus eliminating another site of bacterial contamination and does not have threads that can unravel. Furthermore, the manufacturing technique yields a mat 10 having rounded corners C, which is important for mats used by small children.

Each segment of mat 10 includes padding 14. Padding 14 preferably is a polyurethane foam of an appropriate thickness, preferably between ½ inch and 3 inches, most preferably 1 to 2 inches. The thickness of padding 14 should be sufficient to provide a padded, comfortable rest surface if mat 10 is placed directly on a floor.

The mat 10 of the present invention generally is manufactured and constructed by the following steps:

Two aluminum bottom nests are attached to an aluminum turntable on a radio frequency (RF) vinyl welding machine;

A top sealing brass die is attached to a top heated platen on the RF welding machine;

A "distance down" limiting switch is set for the height of the die;

Copper outside RF shields are set for the down stroke of the brass die;

A bottom limit switch is set for the lowest level for the brass die;

The power level is set for the RF power to the specific die used for sealing on the production run;

The pre-seal time, seal time and cool down time are set on the RF welding machine based upon the thickness and type of vinyl used for the cover;

The lower and upper plate current and power settings are set on the RF welding machine;

The skip switch is set on the "on" position on the turntable drive;

The operation switch on the control panel is set to "Semiautomatic";

A sheet or piece of cover vinyl is placed on one of the bottom aluminum nests so that it completely covers the aluminum;

On one end of the vinyl sheet appropriate tags are positioned under the vinyl on the aluminum nest;

The foam padding is appropriately positioned on the vinyl and centered inside the aluminum bottom nest;

One sheet or piece of vinyl is placed on top of the foam, completely covering the bottom pieces of vinyl;

The start button is activated on the RF welding machine; the turntable rotates 180 degrees and then stops; the RF welding machine upper platen compresses down on the foam and vinyl; after settling for approximately 3 seconds, the RF power is applied and the two sheets of vinyl are welded together at their peripheral edges under the brass die and completely sealed;

The turntable rotates again and a completely sealed mat rotates out of the RF welding machine;

An operator picks up the mat and places it on an inspection table;

The operator pulls off any excess vinyl. On the outside seam is a tear seal that allows the vinyl to pull of cleanly. The excess vinyl is recycled;

The mat is inspected to see that all seams are completely sealed with no foam caught in the seal or any defects in the vinyl; and The mat is place in a shipping box for shipment.

It will be appreciated by those skilled in the art that various changes and modifications can be made in the mat of the present invention without departing from the scope of the appended claims. Therefore, the foregoing description and accompanying drawings are intended to be illustrative only and should not be construed in a limiting sense.

What is claimed is:

1. A process for making a sealed, infection resistant mat, comprising:

placing a first sheet of cover material of a first distinguishable color on a metallic nest, said first sheet of cover material having peripheral edges;

placing a padding material on said first sheet of cover material;

placing a second sheet of cover material of a second distinguishable color over said padding material, said second sheet of cover material having a peripheral edge, the peripheral edges of said second sheet of cover material being placed in contact with said peripheral edges of said first sheet of cover material;

applying a platen against said second sheet of cover material; and applying radio frequency energy through said platen to seal said peripheral edges of said second sheet of cover material to said peripheral edges of said first sheet of cover material with said padding in between, thereby creating a contiguous, visually observable sealed seam from said peripheral edges, the sealed seam having no portals of entry for contaminants.

2. The process of claim 1 further comprising the step of attaching a sealing die to a platen before the step of applying the platen against said second sheet of cover material.

3. The process of claim 1 wherein said step of placing a padding material on said first sheet of cover material further comprises placing a polyurethane foam material on said first sheet of cover material.

4. A process for making a sealed, infection resistant mat, comprising:

placing a first sheet of cover material on a metallic nest, said first sheet of cover material having peripheral edges;

placing segments of padding material on said first section of cover material at predetermined positions corresponding to padded mat segments, placing a second sheet of cover material over said padding material, said second sheet of cover material having a peripheral edge, the peripheral edges of said second sheet of cover material being placed in contact with said peripheral edges of said first sheet of cover material;

applying a platen against said second sheet of cover material;

applying radio frequency energy through said platen to seal said peripheral edges of said second sheet of cover material to said peripheral edges of said first sheet of cover material with said padding in between, thereby creating a contiguous sealed seam from said peripheral edges, the sealed seam having no portals of entry for bacteria, vermin or fluids; and applying radio frequency energy to said first and second cover materials in a pattern between the predetermined segments whereby a seal is formed between the segments with at least one airflow channel formed therein.

* * * * *